United States Patent [19]

Baus

[11] Patent Number: 4,560,320

[45] Date of Patent: Dec. 24, 1985

[54] VENTILATING UNIT

[76] Inventor: Heinz G. Baus, Wartbodenstrasse 35, CH-3626 Hünibach/Thun, Switzerland

[21] Appl. No.: 701,805

[22] Filed: Feb. 19, 1985

Related U.S. Application Data

[63] Continuation of Ser. No. 456,500, Jan. 7, 1983, abandoned.

[30] Foreign Application Priority Data

Jan. 7, 1982 [DE] Fed. Rep. of Germany ..... 3200210

[51] Int. Cl.[4] ..... F24F 13/10

[52] U.S. Cl. ..... 415/118; 98/99.6; 98/39.1; 138/155

[58] Field of Search ..... 415/118, 119, 201, 54; 174/68 C, 101; 220/23, 215, 4 F, 68, 469, 259, 307, 337, 338; 98/31, 32, 39, 114, 116, 118, 99.6, 99.8, DIG. 10

[56] References Cited

U.S. PATENT DOCUMENTS

| | | | |
|---|---|---|---|
| 2,336,765 | 12/1943 | Adam | 98/99.6 |
| 3,251,540 | 5/1966 | Kinsworthy | 415/119 |
| 3,286,914 | 11/1966 | Baverstock | 415/119 |
| 3,331,304 | 7/1967 | Baus | 415/54 |
| 3,570,546 | 3/1971 | Jackson | 138/155 |
| 3,727,644 | 4/1973 | Kagon | 138/155 |
| 4,008,652 | 2/1977 | Baus | 415/54 |
| 4,132,308 | 1/1979 | Goncalves | 220/23 |
| 4,174,020 | 11/1979 | Challis | 415/119 |
| 4,186,656 | 2/1980 | Weber | 98/99.6 |

FOREIGN PATENT DOCUMENTS

| | | | |
|---|---|---|---|
| 1915262 | 5/1965 | Fed. Rep. of Germany . | |
| 2411053 | 9/1975 | Fed. Rep. of Germany . | |
| 2450480 | 5/1976 | Fed. Rep. of Germany | 98/99.6 |
| 2555930 | 6/1977 | Fed. Rep. of Germany . | |
| 7801023 | 5/1978 | Fed. Rep. of Germany . | |
| 2942482 | 4/1981 | Fed. Rep. of Germany . | |

*Primary Examiner*—Robert E. Garrett
*Assistant Examiner*—John Kwon
*Attorney, Agent, or Firm*—Schwartz, Jeffery, Schwaab, Mack, Blumenthal & Evans

[57] ABSTRACT

Ventilating unit comprising a housing to the front of which is fitted, preferably pivotably, a cover-flap. The front of the housing comprises a wall that closes off the interior in which a fan is arranged. Known ventilating units of this kind contain, inside, a plurality of components, more particularly a fan, insulating material, an actuator, etc. These components have hitherto been secured to the housing, and to each other, by means of screws or other attachment-elements, resulting in relatively high material and assembly costs. Furthermore, cleaning of the ventilating ducts, involving opening-up the unit, has been possible only by using trained personnel. In order to overcome this problem it is therefore suggested that the wall be built as an inspection-flap which is hinged to the front edge of the housing and is provided with means for locking it to the housing. In this connection the fan housing is designed, or bears against the said inspection-flap, in such a manner that when the latter is locked, the fan-housing is also locked in the housing. Finally, at least one retaining wall is preferably provided inside and this, together with the inspection-flap, produces a ventilating unit with adequate stability.

20 Claims, 7 Drawing Figures

VENTILATING UNIT

This application is a continuation of application Ser. No. 456,500, filed Jan. 7, 1983, now abandoned.

The invention relates to a ventilating unit comprising a housing to the front of which is fitted, preferably pivotably, a cover-flap, with a wall arranged at the front of the housing by means of which the interior can be closed off, and with a fan arranged in the interior, both the housing and the wall comprising air-passages.

German OS No. 24 11 053 describes a ventilating unit of this kind in which the openings to the air-passages located at the front may be closed or opened by means of a cover-flap. Ventilating units of this kind may be incorporated into openings in walls, window-frames, or the like for the purpose of bringing air into, or taking it out of, a room, for example. The cover-flap is usually activated by a geared motor preferably arranged in the interior of the housing. Also arranged within the housing is a fan for the purpose of obtaining an adequate flow of air for aerating and deaerating. Effective sound insulation is obtained to an increasing degree by means of insulating material in the interior, by means of which winding flow-paths can be suitably predetermined. In known ventilating units, a not inconsiderable expenditure is required to secure the components firmly and reliably in the interior. Screwed connections are frequently used for this purpose and these are expensive to produce and assemble. In addition to this, many difficulties arise when the ventilating unit has to be opened up for maintenance or cleaning of the interior.

It is therefore the purpose of the invention to design a ventilating unit of the type mentioned hereinbefore in such a manner that it is simple and inexpensive to produce. Furthermore, the unit is to be easy to service and is to provide easy access to components in the interior. The unit is also to be easily adaptable to given operating conditions, using mainly the same components. Finally, the unit is to have a high degree of reliability and to be able to cope with operational situations.

According to the invention, this purpose is achieved in that the wall is in the form of an inspection-flap hinged to the front of the housing, in that the inspection-flap is provided with means for locking it to the housing, in that the fan-housing is designed, and bears against the inspection-flap, in such a manner that when the latter is locked, the fan-housing is also locked in the outer housing, and in that at least one retaining wall is provided, preferably in the interior of the outer housing.

The ventilating unit according to the invention is noted mainly for its simple, inexpensive design, the inspection-flap providing easy access to the interior. Actuation of the locking means allows the inspection-flap to be removed from the housing, making the interior, and the components therein, easily accessible. This is of particular significance when the air-passages in the interior must be cleaned for maintenance purposes. Even the fan and actuator are easily accessible. In other words there is no need to remove screws or other means of attachment from individual components, only the inspection-flap need be removed. According to the invention, the inspection-flap is, on the one hand, inserted into a longitudinal groove in the housing and, on the other hand, is adapted to be connected thereto by locking means. It is emphasized, in this connection, that the locking means are preferably in the form of so-called quick-release fasteners which are easily operated without special tools. It is also pointed out that the inspection-flap may also be provided with a longitudinal groove in which corresponding parts of the housing engage for the purpose of providing a suitable connection. The fact that the rigidity of the box-like housing is increased by means of the inspection-flap is also of decisive importance. In addition to this, even if the housing is deformed or twisted by external forces, the inspection-flap itself undergoes practically no deformation, and this ensures that the cover-flap provides a sealed closure at all times.

According to one preferred embodiment, the inspection-flap is hinged to one front edge of the housing, hereinafter referred to as the outer housing.

The inspection-flap may be pivoted away from the outer housing, in the same way as a cover-flap, merely by releasing the locking means, whereupon the interior of the outer housing immediately becomes accessible. It is desirable for the front edge of the outer housing to be at least partly more or less cylindrical in shape, so that it can be embraced by an arcuate extension of the inspection-flap. The arcuate extension thus engages in the longitudinal groove in the vicinity of the front edge of the outer housing, thus ensuring, on the one hand, reliable retention of the inspection-flap and, on the other hand, allowing the flap to pivot easily in relation to the outer housing.

According to one particularly desirable configuration, the longitudinal groove in the outer housing and/or the lower edge of the inspection-flap are designed in such a manner that, after the flap has been pivoted away from the housing through a predetermined angle, preferably on the order of 90°, the flap can be removed from the housing. It is thus a simple matter to separate the flap from the housing and this greatly facilitates access to the interior.

In one desirable embodiment, the locking means comprise a rotatable bolt with a rotating lever which is adapted to be brought into engagement with a strip and/or a groove in the outer housing.

According to one particularly advantageous embodiment, the inspection flap comprises, at both the upper and the lower end, a longitudinal front edge having an at least partly cylindrical surface. This makes it possible to hinge the cover-flap selectively to the upper or lower longitudinal edge, depending upon how the ventilating unit is installed.

It is an advantage for the inspection-flag to be provided with at least one air-passage and with an aperture for the cover-flap actuating means. These openings may easily be provided, at the required locations in the inspection-flap, for example by stamping-out. Like the cover-flap, the inspection-flap is preferably an extruded section cut to the required length and is therefore inexpensive to produce.

It is desirable for the internal walls of the outer housing and/or the internal surface of the inspection-flap and/or of the cover-flap to be lined with sound-insulating material. This may be easily achieved by the use of an adhesive. If the sound-insulating material is suitably shaped, particularly effective sound-insulation is obtained.

According to one particularly advantageous example of embodiment, the sound-insulating material on the upper and lower internal surfaces exhibits tooth-like webs which are spaced apart but project into each other in such a manner as to form a meander-pattern airflow-duct in the interior, with the air flowing substantially in the longitudinal direction of the ventilating unit. Obviously the length of the flow-duct can be predetermined by the overall length of the ventilating unit. The sound-insulating effect may be influenced in the manner desired by the design and number of the webs and by the length and width of the flow-duct. In this connection it is of particular significance that the sound-insulating material can easily be produced with the webs and arranged in the interior of the unit. As soon as the inspection-flap is opened, the flow-duct is easily accessible and can thus be cleaned by simple means, for example a vacuum-cleaner.

In one particular advantageous embodiment, at least one flow-duct running in the direction of the longitudinal axis is provided in the interior of the outer housing, the fan being arranged at the opening to the duct where the air emerges from the ventilating unit. With a ventilating unit of appropriate overall length, the size of the flow-duct, preferably lined with sound-insulating material, necessary to obtain the required sound-insulation may be predetermined. This makes it a simple matter to design a ventilating unit of comparatively small structural height and depth, suitable for the usually limited amount of space available in window-frames or wall-openings, especially since dimensional restrictions are usually less in the direction of the longitudinal axis.

It is desirable for the fan to be in the form of a drum-fan, preferably a radial fan, which runs at comparatively low r.p.m. with its axis of rotation parallel with the longitudinal axis of the outer housing. With a fan of suitable length it is possible to achieve satisfactory sound-insulation even with reduced structural height and depth, since the low r.p.m. of the fan keeps the inherent noise-level down.

In one advantageous embodiment, use is made of two fans driven by a common motor. In this case, the flow-ducts running in the longitudinal direction of the outer housing are arranged symmetrically on both sides of the fans. This symmetrical arrangement and design reduces production costs, especially since the sound-insulating material for both flow-ducts is the same.

In order to obtain a simple and inexpensive structure, the cross-section of the outer housing is substantially U-shaped, with the opening at the front closed off by the inspection-flap. The various components, more particularly the fans, sound-insulating material, retaining walls, and the actuator for the cover-flap, can thus be easily installed without special tools or complex assembly procedures.

It is desirable for the outer surface of the fan-housing to be provided with longitudinal channels opening towards the outside, in which support-elements are arranged, said support-elements bearing against the inner walls of the outer housing and/or the inspection-flap or the sound-insulating material thereon. It should be emphasized that, with appropriate dimensions, the fan-housing thus designed may be, as it were, press-fit in the interior of the outer housing requiring no additional attachment elements. The said support-elements provide reliable support for the fan-housing, thus simplifying compensation for production tolerances. Suitable pressure can obviously be applied by closing the inspection-flap, to ensure location of the fan-housing.

The support-elements are preferably made of a flexible, resilient material and they extend over the entire length of the fan-housing. Support-elements of this kind are produced inexpensively from sections cut to length and they easily provide compensation for tolerances within wide limits.

It is desirable to provide four such longitudinal channels associated with the corners of the outer housing. The support-elements arranged in the channels thus engage in the corners of the outer housing, thus providing a particularly simple means of preventing the fan-housing from rotating.

Two longitudinal channels are preferably arranged in the two end-areas of the fan-housing, said areas constituting the outlet duct from the fan-housing. The outlet duct is directed towards the inspection-flap and the support-elements in the longitudinal channels thus bear against the inspection-flap or against the insulating material thereon. This ensures that when the inspection-flag is closed, a certain amount of pressure is applied by the support-elements to the fan-housing, for reliable positioning of the latter in the interior of the outer housing. In addition to this, it is of decisive importance that the support-elements also provide reliable sealing, in order to prevent the air-passages between the fan-inlet and the outlet-duct from being short-circuited. In this connection the flexibility of the sound-insulating material and/or of the support-elements is of prime importance.

In one particularly important embodiment, a retaining wall is provided at least at each end in the interior, said wall being preferably secured in the longitudinal channels of the outer housing by attachment means. Such retaining walls greatly improve the stability of the ventilating unit. This allows the outer housing to be made of compartively thin material, which saves a considerable amount of material and weight. It should be pointed out at this time that the outer housing, the cover-flap and the inspection-flap are all made of extruded material, optimal material-utilization being assured by the retaining walls according to the invention.

In one advantageous development, the longitudinal channels comprise undercut areas in which said attachment-elements engage, the latter being preferably in the form of screws or T-shaped projections from the retaining wall. This ensures particularly simple and reliable attachment of the retaining walls.

The retaining wall comprises at least one hole or recess arranged at right angles to the rear wall of the outer housing, into which a means of attachment, preferably a screw, may be inserted. If a matching hole is provided in the rear wall, the ventilating unit may easily be attached to other components by the attachment means. For instance, for the purpose of increasing the sound-insulation, an adapter-section may be connected to the ventilating unit. The unit may furthermore be incorporated into existing ventilating structures, the necessary connection being made merely with the aforesaid attachment means.

In one particularly advantageous embodiment, the retaining wall is provided with openings, at least in the interior, a connecting web being provided in the vicinity of the inspection-flap. The connecting web is provided with an opening through which the above-mentioned attachment-means, and/or a screwdriver or the like, may be passed, the diameter of the opening larger than that of the aforesaid hole. The openings also save a considerable amount of material. Furthermore, the opening ensures that the means of attachment can be reached and actuated without difficulty.

In one particularly advantageous embodiment, the inspection-flap stop in the outer housing is in the form of a labyrinth-seal. A seal of this kind is an inexpensive way of preventing the entry of outside air into the interior or into the flow-duct.

The cover-flap stop on the inspection-flap is also preferably a labyrinth-seal. If the ventilating unit is not in operation, and the cover-flap is therefore closed, this seal prevents any unwanted flow of air. It should be emphasized at this point that the hinging of the cover-flap to the inspection-flap, i.e. the front longitudinal edge, and the previously explained jaw on the cover-flap, also act as a labyrinth-seal. This ensures that when the cover-flap is closed, any unwanted flow of air is effectively prevented.

In one advantageous embodiment, a longitudinal channel is provided, preferably in the vicinity of the front edge of the housing, the electrical leads for the fan-motor and/or for the actuator being arranged in said channel. The channel may easily be enclosed by means of a suitable section, thus preventing the electrical leads from being affected by external factors.

The longitudinal channel preferably also serves to accommodate the aforesaid means of attachment of the retaining wall, thus having a dual function producing a not inconsiderable cost-saving.

According to one preferred embodiment of the ventilating unit according to the invention, the longitudinal channel and/or the front edge of the housing and/or the inspection-flap are all designed in such a manner that the inspection-flap, preferably after a small pivoting motion, may be removed from the housing. This design is particularly suitable in cases where the front surface of the ventilating unit lies substantially flush with other components, for example window-frames, walls, or the like. Since, upon being opened, the inspection-flap need be pivoted only through a small angle, there need be practically no free space under the lower wall of the housing which would otherwise be needed to accommodate the lower edge of the inspection-flap.

In one particularly advantageous embodiment, the longitudinal groove and/or the front edge of the housing and/or an extension on the inspection-flap are arranged, in relation to the rear wall at an angle a of less than 90°, preferably less than 45°, and advantageously less than 20°. In this case, the inspection-flap need be pivoted only through a small angle and can then be removed, in this pivoted position, upwardly from the housing. Of particular significance, in this connection, are arrangements with angles on the order of 20°, or possibly less, since this means that only very small pivoting motions are needed before the inspection-flap may easily be removed upwardly. It need scarcely be pointed out that, with such small angles, the free space under the lower edge of the housing can be kept so small that it is almost invisible. This makes it easy to obtain a flush arrangement of the front surface of the ventilating unit and the cover flap with other components.

A preferred embodiment of the invention will now be described with reference to the appended drawing wherein.

Figure 1:
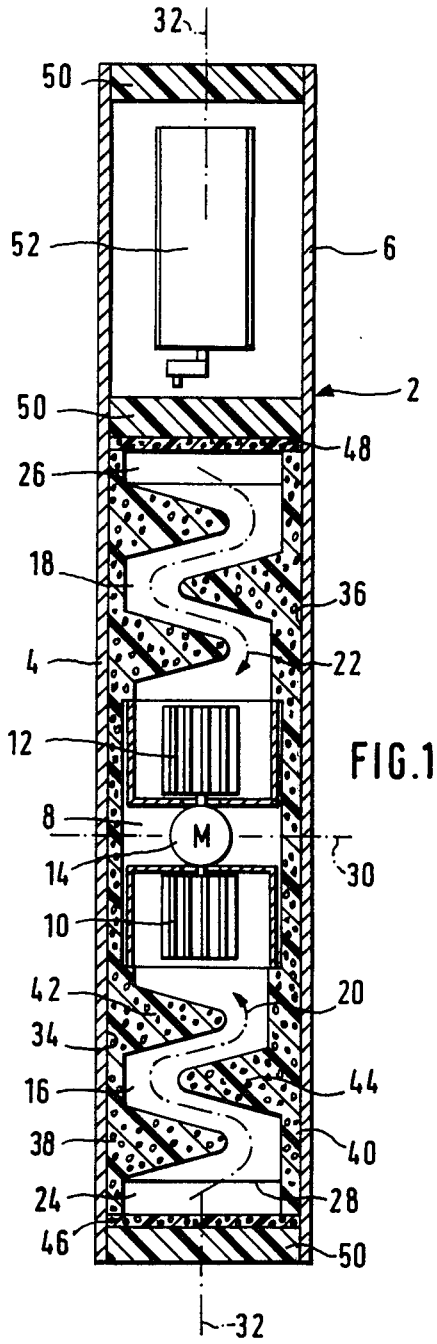
FIG. 1 is a diagrammatical longitudinal section through a ventilating unit having two symmetrically arranged flow-ducts.

FIG. 1 is a longitudinal section through a ventilating unit having a U-shaped or box-like outer housing 2, showing an upper wall 4 and a lower wall 6. Outer housing 2 is an extruded section. A rear wall 28, lying behind the plane of the drawing, joins the walls 4 and 6, forming an interior 8. Located in interior 8 are two fans 10,12 which are in the form of drum-fans and are driven by a common electric motor 14. Arranged symmetrically with each of the fans is a flow-duct 16,18 through which air drawn in by fans 10,12, in the direction of dotted arrows 20, can flow. Located at the ends of ducts 16,18 are air-passage openings 24,26 arranged in wall 28 located behind the plane of the paper. Further air-passage openings are located in an inspection-flap, not shown here, and located in front of the plane of the drawing, said flap being explained in greater detail hereinafter. It is assumed that rear wall 28 is associated with the outside of a window, for example, whereas the inspection-flap is associated with the inside, i.e. the interior of the building. The ventilating unit shown therefore serves to aerate the room. If the unit is to be used for deaerating the room, air-passage openings 24,26 must accordingly be arranged in the inspection-flap, while those associated with the fans must be arranged in the rear wall; fans 10,12 being installed in outer housing 2 rotated through 180° about vertical axis 30. There is thus no particular problem in using the unit either for aerating or deaerating. In either case, the direction of flow is as indicated by arrows 20,22 and the flow within the outer housing is substantially in the direction of longitudinal axis 32.

Upper and lower internal surfaces 34,36 of outer housing 2 are lined with sound-insulating material 38,40 in the form of spaced tooth-like webs 42,44. These webs project into each other, as shown, but are spaced apart, the resulting flow ducts 16,18 thus following approximately a meander-pattern. The sound-insulating effect may be influenced as required by varying the dimensions, spacing and number of the toothed webs. If the structural length of the ventilating unit is increased, obviously the flow-paths and the sound-insulating effects are increased. On the other hand, the throughput of air may also be governed by the geometry of the flow-paths. Suitable sound-insulating material 46,48 is also provided at the ends of flow-ducts 16,18, on the rear wall and on the inspection-flap.

Retaining walls 50 are provided in the interior of outer housing 2. An actuator 52 is indicated diagrammatically on the right in the interior, said actuator being used to control a cover-flap to be referred to hereinafter. Located between the actuator and flow-duct 18 is a further retaining wall 50. This wall greatly improves the stability and strength of outer housing 2, and thus of the entire ventilating unit. If it were not for these retaining walls, outer housing 2 would have to be made of substantially thicker material and more stable. It would thus require more material and would also be heavier.

Figure 2:
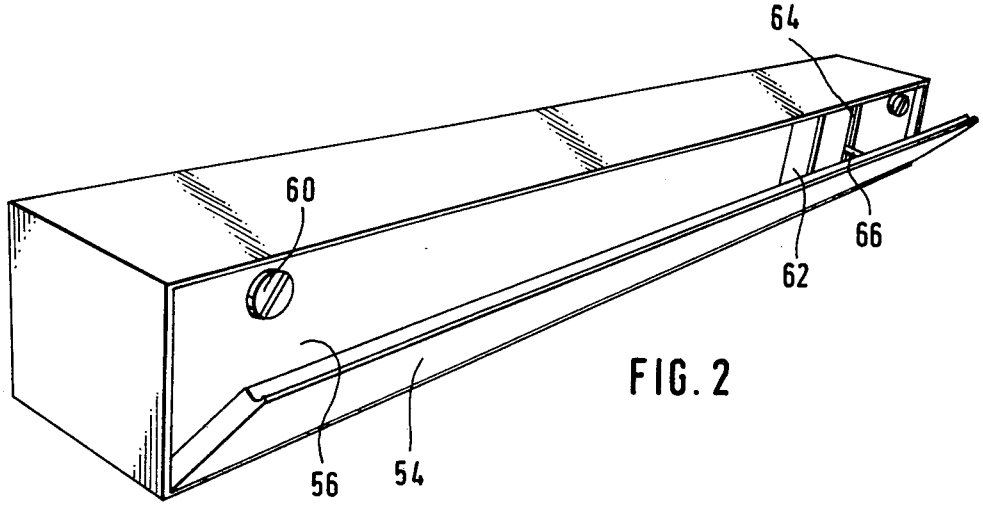
FIG. 2 is a perspective view of a ventilating unit with the cover-flap open.

FIG. 2 is a perspective view of a ventilating unit with cover-flap 54 in open position. Also shown is an inspection-flap 56 which is also arranged on front 58. The inspection flap comprises locking means 60 which can be operated by means of a screwdriver or a coin, in order to open the inspection-flap. In the embodiment shown here, the inspection-flap has only one air-passage opening 62 through which air emerges for the purpose of aerating a room, for example. For the sake of clarification, it may be pointed out that, in contrast to FIG. 1, the unit shown here has only a single fan. Inspection-flap 56 also comprises an aperture 64 for an actuating element 66 which communicates, on the one hand, with the above-mentioned actuator and, on the other hand, with cover-flap 54. The cover-flap may therefore be opened and also closed by the actuator. Both the cover-flap and the inspection-flap extend over the entire structural length of the ventilating unit and also, approximately, over the entire height thereof.

Figure 3:
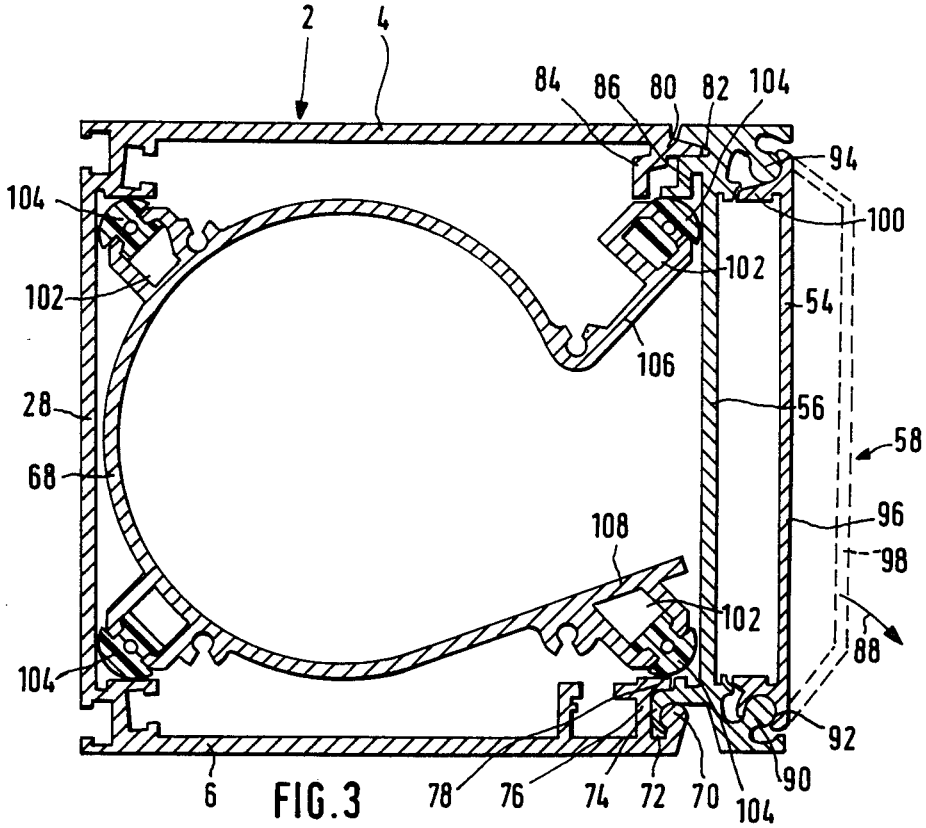
FIG. 3 shows a section at right angles to the longitudinal axis, in the vicinity of the fan, only the housing thereof being shown.

FIG. 3 is a section at right angles to the longitudinal axis, in the vicinity of one of the fans, only the housing 68 of the fan being shown. Box-like outer housing 2 may be recognized by its upper wall 4, its lower wall 6 and its rear wall 28. Outer housing 2 is adapted to be closed at front 58 by means of inspection-flap 56, said flap being shown here in the closed position. Outer housing 2 has, in the vicinity of its front edge 70, a longitudinal groove 72, the front edge 70 defining a surface which is at least partly cylindrical. A lower, approximately arcuate, extension 74 of inspection-flap 56 engages in the longitudinal groove 72. The inspection-flap is thus hinged to outer housing 2 so that it can pivot about front edge 70.

Outer housing 2 also has an approximately L-shaped section 76 which, on the one hand, defines longitudinal groove 72 and, on the other hand, embraces arcuate extension 74 by its upper part 78. This is a simple way of forming a labyrinth-seal to prevent outside air from entering interior 8.

The upper stop for inspection-flap 56, on upper wall 4, is also in the form of a labyrinth-seal, a tooth-shaped extension 80 projecting into a longitudinal groove 82 in the inspection-flap and bent webs 84, 86, associated with each other, being provided both on upper wall 4 and inspection-flap 56. This also constitutes a labyrinth seal, ensuring reliable sealing at low cost. Arcuate extension 74 is designed, and extends over an angle, in such a manner that after inspection-flap 56 has been pivoted in the direction of arrow 88, a predetermined angle, preferably about 90°, the flap may easily be removed from outer housing 2. Cover-flap 54, hinged to inspection-flap 56, may then also be removed simultaneously.

Inspection-flap 56 comprises a front longitudinal groove 90 to which cover-flap 54 is hinged. The longitudinal edge also defines a surface which is at least partly cylindrical, and which is embraced by a jaw 92 on the cover-flap 54, said jaw being preferably designed in such a manner that the cover-flap and inspection-flap may be separated from, or attached to, each other merely by relative movements in the direction of the longitudinal axis running at right angles to the plane of the drawing. This reliably prevents inadvertent release of the cover-flap while the unit is in operation or during inspection and cleaning. It is of special significance that the inspection-flap has an additional longitudinal edge 94 at the top, the design of which is similar to that of longitudinal edge 90 described above, so that cover-flap 54 may be hinged selectively to one of these longitudinal edges 90,94. This is a simple way of allowing the cover-flap to be hinged and pivoted in accordance with installation requirements for the ventilating unit. Thus the design of the cover-flap and inspection-flap according to the invention involves a double hinge, the cover-flap being hinged to the inspection-flap and the latter being hinged in turn to the outer housing 2. Both flaps extend substantially over the entire structural height of the unit, i.e. the distance between upper wall 4 and lower wall 6. In the embodiment illustrated, cover-flap 54 has a flat front surface 96. However, as indicated in dotted lines, the cover-flap may easily be adapted to the design of other components, for example a window-frame or a door. It should be emphasized at this time that cover-flap 54 extends over the entire structural length of the unit, i.e. in the direction of the longitudinal axis running at right angles to the plane of the drawing. It may be gathered that jaw 92, in conjunction with front longitudinal edge 90, forms a labyrinth-seal, it being possible to improve the sealing action by the addition of further webs or the like. A labyrinth-seal is also provided at the upper stop between cover-flap 54 and inspection-flap 56, the cover-flap comprising a transverse web 100 the surface of which passes over into an arcuate area of the cover-flap. Transverse web 100 bears against inspection-flap 56 and against a web associated therewith. There is no need to explain that this provides a simple and reliable labyrinth-seal preventing any flow of air from or to the interior when the cover-flap is closed. Moreover, transverse web 100 increases the stability and rigidity of of cover-flap 54. According to the invention, this provides a tight seal.

The outer surface of fan-housing 68 comprises longitudinal channels 102, opening outwardly, containing supporting elements 104 made of a flexible resilient material. Both the longitudinal channels and the supporting elements extend over the entire length of the fan-housing. Altogether, four such longitudinal channels 102 are provided and are arranged substantially in the corner-areas of outer housing 2. It will be seen that this locks the fan-housing reliably and prevents it from rotating, since the said supporting elements engage in corners and edges of outer housing 2 in the manner shown, thus providing a reliable mounting. The supporting elements provide, on the one hand, a simple means of compensating for tolerances and, on the other hand, effective decoupling between the fan-housing and the outer housing for the purpose of preventing the transfer of acoustic oscillations vibrations, or the like. However, the two supporting elements 104 near the front are also, partially or entirely, supported by inspection-flap 56. When the latter is closed, there is no difficulty in obtaining the required pressure or bracing to ensure that fan-housing 68 is securely mounted in outer housing 2. It is expressly emphasized that, in principle, there is no need for any separate means of attachment for fan-housing 68 in outer housing 2, since the design according to the invention provides the firm support explained before. With inspection-flap 56 open, fan-housing 68 is simply pushed through the front opening between walls 4 and 6 of the outer housing. As soon as the inspection-flap is closed, the fan-housing is securely mounted in the outer housing by supporting elements 104. The above-mentioned longitudinal channels 102, provided at the front, are arranged in the two end-areas 106,108 forming the outlet duct from the fan-housing.

Figure 4:
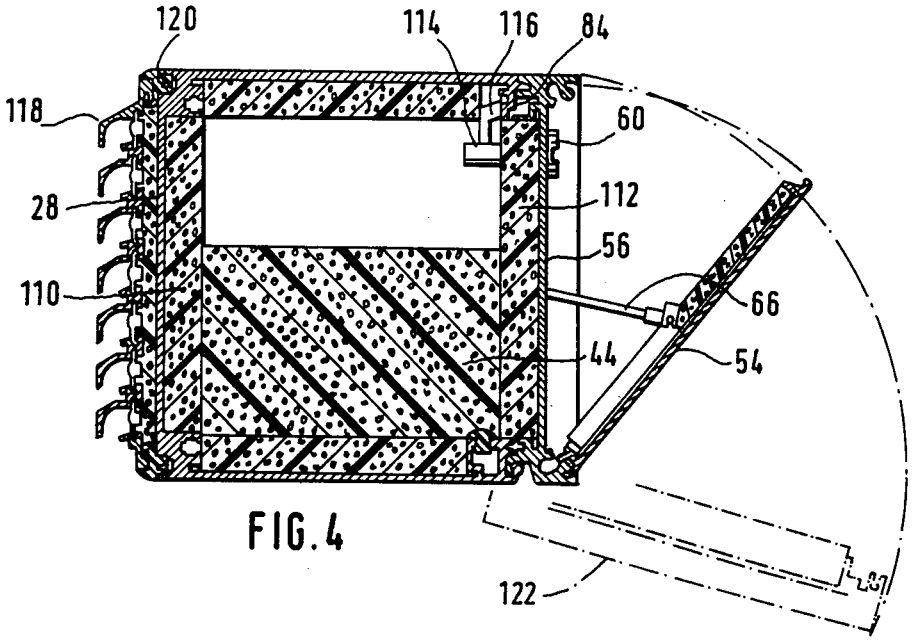
FIG. 4 is a section at right angles to the longitudinal axis, in the vicinity of one of the flow-ducts.

FIG. 4 is a section at right angles to the longitudinal axis and in the vicinity of of flow-duct 16, with cover-flap 54 in the open position. The tooth-like web 44 occupies a part of the height of the interior. Rear wall 28 and inspection-flap 56 are also lined with sound-insulating material 110,112. Also visible are locking means 60 comprising a rotatable bolt 114 and a rotating lever 116 connected therewith. In the position shown, the lever 116 is in engagement with strip or web 84, so that inspection-flap 56 is held securely in the closed position. In order to open inspection-flap, all that is needed is to turn locking means 60 until lever 116 is disengaged from strip 84. It should be pointed out that the strip or web 84 is also a part of the above-mentioned labyrinth seal. Weather-stripping 118 is provided for rear wall 28 to prevent dirt, rain, or foreign bodies from entering the air-passage openings provided therein. Connection between weather-stripping 118, rear wall 28, and outer housing 2 is effected by means of connecting sections 120 engaging in corresponding grooves or recesses in the weather-stripping and rear wall. Dotted lines 122 show the inspection-flap in open position after it has pivoted through an angle of about 90°. It will be seen that inspection-flap 56, complete with cover-flap 54 may now be removed from outer housing 2 merely by releasing actuating element 66 from the cover-flap, since the actuating element is not attached to the inspection-flap, but passes through a slot 64 therein and is hinged to the cover-flap.

Figure 5:
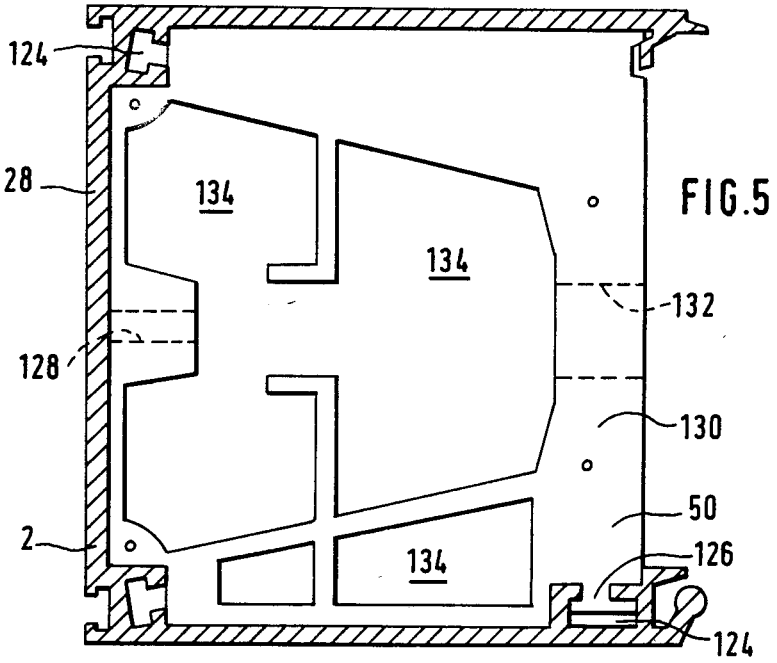
FIG. 5 is a view of a retaining wall.

FIG. 5 is a section through outer housing 2, showing retaining wall 50 arranged therein. The housing comprises two longitudinal channels 124 in which the attachment elements for the retaining wall engage. In the vicinity of rear wall 28, these attachment elements are in the form of screws, the heads of which engage in the longitudinal channels and which pass through corresponding holes in the retaining wall. In the vicinity of the front edge, the retaining wall comprises a T-shaped member 126 engaging with longitudinal channel 124 at that point. The channel also serves to accommodate the electrical leads running to the fan-motor or to the actuator. The longitudinal channels 124 comprise undercut areas to allow the attachment elements to be reliably anchored. Retaining wall 50 also comprises a passage 128, running at right angles to rear wall 28, into which an attachment means, more particularly a screw, may be introduced. If necessary, a corresponding passage may be provided in rear wall 28, so that the screw can also pass therethrough. It will be seen that this makes it possible for the ventilating unit to be secured to an existing vent-grill frame, or the like. Retaining wall 50 also comprises, facing rear wall 28, a connecting web 130 having an opening 132 of larger diameter than passage 128 facing it. A screw and a screwdriver, or some other tool for driving it, may be passed through opening 132. Retaining wall 50 is not solid but has a number of openings 134, only those running in the direction of the longitudinal axis being visible in this case. These openings, and optimal material-utilization, ensure that the retaining wall possesses the highest possible stability and strength.

Figure 6:
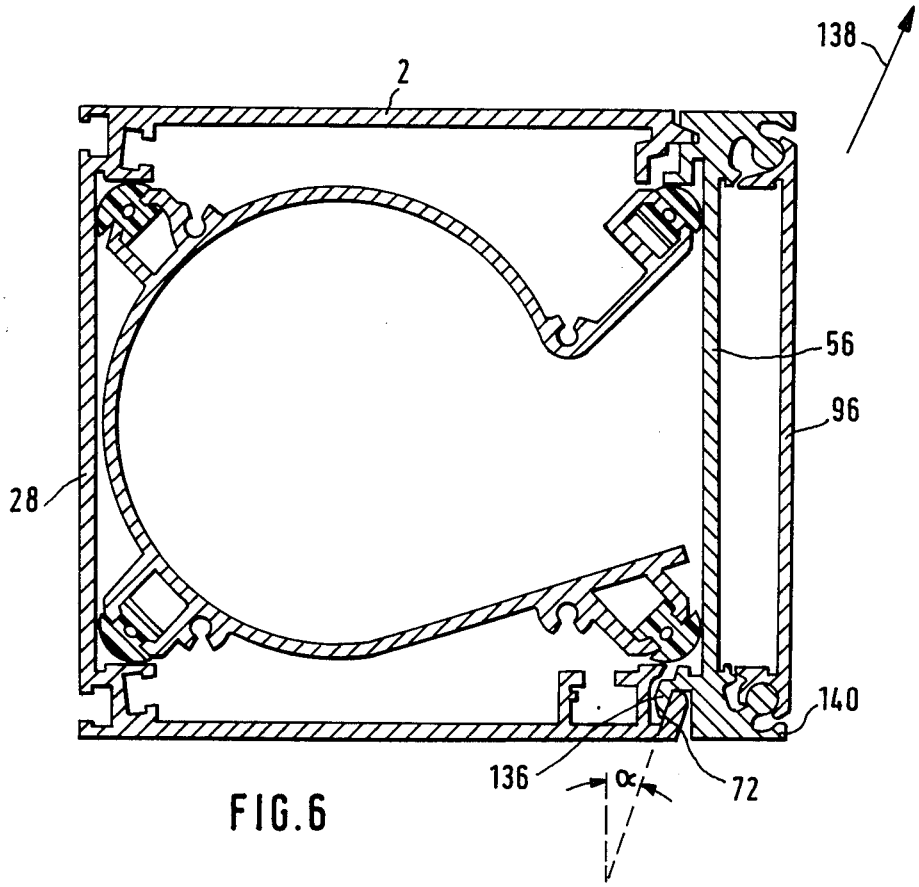
FIG. 6 is a section similar to that in FIG. 3 in which the longitudinal groove of the front edge runs at a small angle to the rear wall.

FIG. 6 illustrates an alternative design in which longitudinal groove 72 extends at a small angle a in relation to rear wall 28, i.e. to a vertical plane in the position shown. Extension 136 of inspection-flap 56, engaging in the longitudinal groove, is provided accordingly at a small angle a so that it may engage in the groove. In order to remove inspection-flap 56, together with cover flap 54, from housing 2, all that need be done, after releasing the locking means, not shown here, is to pivot the flaps through angle a, after which they may be lifted, in the direction of arrow 138, upwardly out of longitudinal groove 72. At this time, the front area of lower edge 140 moves only relatively slightly downwards, so that scarcely any free space need be provided there. As a result of this design of the ventilating unit, it is possible to install the unit to fit flush in a window-frame, wall or the like without any production problems.

Figure 7:
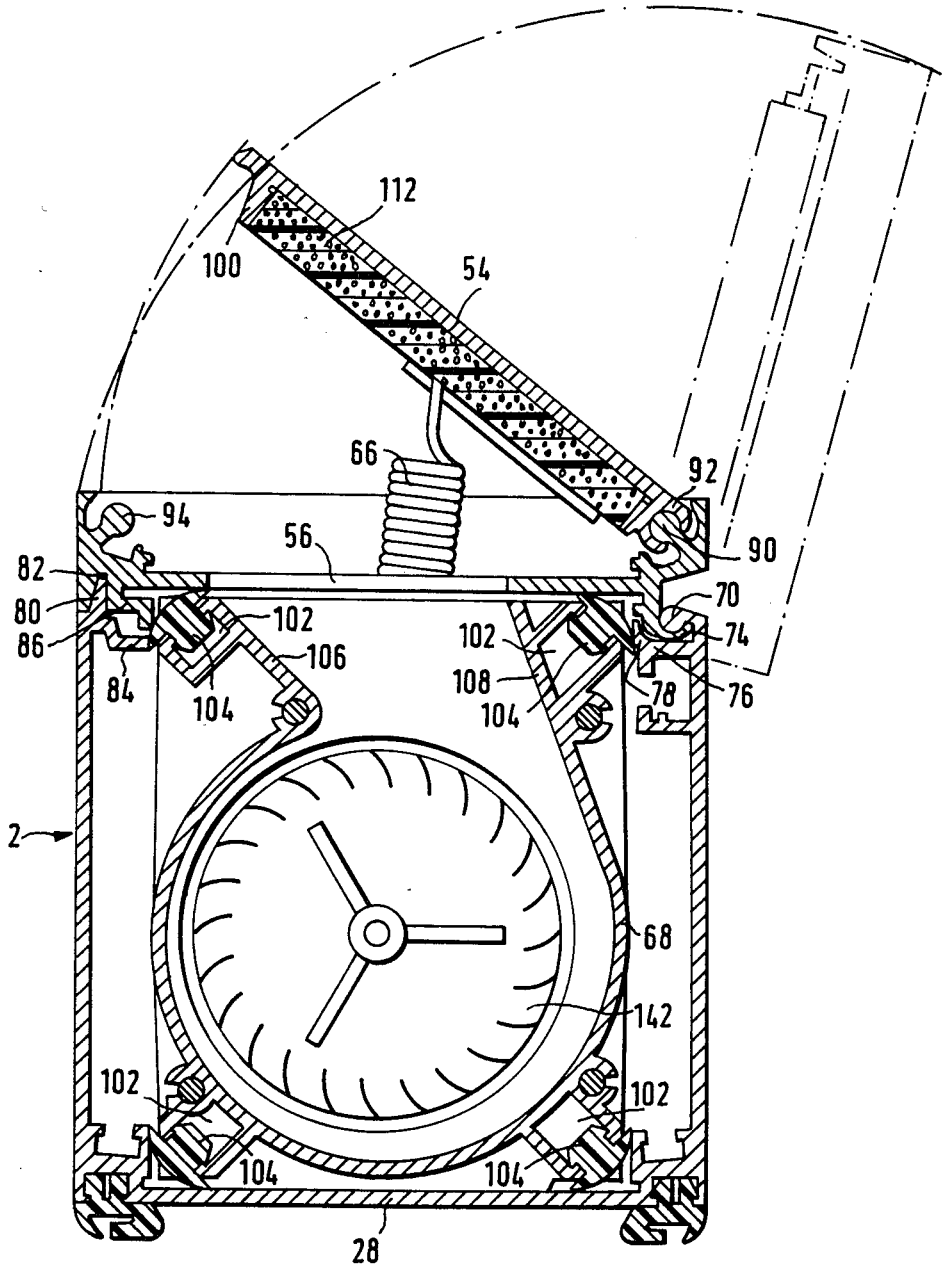
FIG. 7 is a section similar to that in FIG. 3, but with the cover-flap pivoted around the front longitudinal edge of the inspection flap.

FIG. 7 is a section similar to that in FIG. 3, but in this case cover-flap 54 pivots about front longitudinal edge 90 of inspection-flap 56. Aerating or deaerating can now be carried out in the usual fashion by means of fan or fans 142 arranged in fan-housing 68. Cover-flap 54 is pivoted into the position shown by means of an actuating element 66 designed, in this case, in the form of a spring. There is no need to make special mention of the fact that the actuating element 66 is connected to an appropriate device, more particularly a stepping motor. The pivoted position of inspection-flap 56 is also indicated, in dotted lines. As explained above, inspection-flap 56 may be released from housing 2 by actuating the locking means, in such a manner that both the inspection-flap and the cover-flap can be pivoted about front edge 70 of the housing. With the inspection-flap in the pivoted position, the fans and any other previously mentioned components of the ventilating unit, are easily accessible. It is significant that when the said inspection-flap is closed and locked, fan-housing 68 is also locked in housing 2. According to the invention, therefore, no additional means of attachment, or the like, are provided for the fan-housing. Instead, the fan-housing is locked firmly and reliably in position in housing 2 by supporting elements 104.

The embodiments of the invention in which an exclusive property or privilege is claimed are defined as follows:

1. A ventilating unit comprising:

a housing having walls forming a substantially U-shaped cross-section with an open face and defining an interior space having a longitudinal axis;

an inspection-flap pivotably mounted on a longitudinal edge of said housing and extending substantially over the entire length of said housing for closing the open face of said housing, said inspection-flap being provided with an airway opening and with an actuating element opening therethrough;

locking means for securing said pivotably mounted inspection-flap to said housing in a position to close the open face of said housing;

a cover-flap pivotably mounted on a longitudinal edge of said inspection-flap for selectively covering and uncovering said inspection-flap and airway opening;

an actuating element extending through said actuating element opening in said inspection-flap and operatively connected with said cover-flap to selectively pivot said cover-flap;

at least one transverse retaining wall arranged in the interior of said housing; and a fan-housing disposed in said interior space and containing a fan for moving air through said airway opening, said fan-housing being slidable through the open face of said housing when said inspection-flap is opened;

said fan-housing being provided on its exterior with four resilient support elements which engage corners of the ventilating unit housing and the inspection-flap when said inspection-flap is closed such that said fan-housing is firmly supported in the interior space of said housing by said resilient support elements when said inspection-flap is closed whereby rotation of said fan-housing around said longitudinal axis is prevented and secured in said interior space when said locking means are secured.

2. A ventilating unit according to claim 1, characterized in that the front longitudinal edge of the inspection-flap comprises a partly cylindrical surface embraced by a jaw on the cover-flap.

3. A ventilating unit according to claim 1, characterized in that the cover-flap is adapted to be hinged selectively to one of the lower longitudinal edge and the upper longitudinal edge of the inspection-flap.

4. A ventilating unit according to claim 1, characterized in that insulating material mounted on opposed walls of the housing is provided with spaced apart toothed webs which project into overlapping position in order to form a meander-pattern air-flow duct, said webs running at right angles to the longitudinal axis of and extending over the entire width of the housing.

5. A ventilating unit according to claim 4, characterized in that at least one flow-duct, runs in the direction of the longitudinal axis of the housing, and in that the fan is arranged at the opening of an air-passage from which air emerges through the ventilating unit.

6. A ventilating unit according to claim 1, characterized in that the outer surface of the fan-housing comprises a plurality of outwardly opening longitudinal channels, supporting-elements being arranged in said longitudinal channels, and said supporting elements bearing upon inner surfaces of the housing and the inspection-flap and against the insulating material located thereon.

7. A ventilating unit according to claim 6, characterized in that the supporting elements are made of a flexible, resilient material and extend over the entire length of the fan-housing.

8. A ventilating unit according to claim 6, characterized in that two longitudinal channels are arranged in end areas of the fan-housing constituting a fan outlet duct, and in that the supporting elements in these two longitudinal channels bear at least partly against the inspection-flap.

9. A ventilating unit according to claim 6, characterized in that a retaining wall is provided at each end of the housing in the interior thereof, each said retaining wall being secured by attachment elements in the longitudinal channels of the fan-housing, said longitudinal channels comprising undercut areas in which attachment elements for the retaining walls engage, said attachment elements being selected from screws and T-shaped extensions of said retaining walls.

10. A ventilating unit according to claim 6, characterized in that a retaining wall is provided at each end of the fan-housing in the interior thereof, each said retaining wall being secured by attachment elements in the longitudinal channels of the housing, and each retaining wall comprising at least one hole arranged at right angles to the rear wall of the housing, into which an attachment means may be introduced.

11. A ventilating unit according to claim 10, characterized in that the retaining wall comprises, at least in the interior, openings, and in that a connecting web, having an opening, is provided in the vicinity of the inspection-flap, through which opening the attachment means and a tool therefor may be passed, the diameter of said opening being larger than that of said whole associated therewith into which the attachment means may be introduced.

12. A ventilating unit according to claim 1, characterized in that the inspection-flap stop on the housing is in the form of a labyrinth-seal.

13. A ventilating unit according to claim 1, characterized in that the cover-flap stop on the inspection-flap is in the form of a labyrinth-seal.

14. A ventilating unit according to claim 1, characterized in that a longitudinal channel is provided in the vicinity of the front edge of the housing to receive electrical leads for the fan-motor and for the actuator.

15. A ventilating unit according to claim 14, characterized in that said longitudinal channel also serves to accommodate attachment-elements for the retaining wall.

16. A ventilating unit according to claim 1, characterized in that said locking means is mounted on said inspection-flap and comprises a member which engages a portion of said housing when said inspection-flap is secured in the closed position.

17. A ventilating unit according to claim 1, characterized in that the pivotable mounting between said inspection-flap and said housing is designed with a longitudinal groove in a front edge of said housing such that after the inspection-flap has been pivoted away from the housing through a predetermined angle, the inspection-flap may be removed from the housing by simply lifting it out of the groove.

18. A ventilating unit according to claim 17, characterized in that the locking means comprises a rotatable bolt with a rotating lever adapted to be brought into engagement with a portion of the housing.

19. A ventilating unit according to claim 17, characterized in that the front edge of said housing and a mating projection on the inspection-flap are arranged at an angle of less than about 45° in relation to the rear wall of the housing.

20. A ventilating unit according to claim 19, characterized in that the front edge of said housing and the mating projection on said inspection-flap are arranged at an angle of less than about 20° in relation to the rear wall of the housing.

* * * * *